US011041643B2

(12) United States Patent
Jung et al.

(10) Patent No.: US 11,041,643 B2
(45) Date of Patent: Jun. 22, 2021

(54) AIR CONDITIONER

(71) Applicant: Samsung Electronics Co., Ltd., Suwon-si (KR)

(72) Inventors: Chang Woo Jung, Suwon-si (KR); Moon Sun Shin, Suwon-si (KR); Yeon Seob Yun, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 179 days.

(21) Appl. No.: 15/763,233

(22) PCT Filed: Oct. 5, 2016

(86) PCT No.: PCT/KR2016/011128
§ 371 (c)(1),
(2) Date: Mar. 26, 2018

(87) PCT Pub. No.: WO2017/065447
PCT Pub. Date: Apr. 20, 2017

(65) Prior Publication Data

US 2018/0274798 A1 Sep. 27, 2018

(30) Foreign Application Priority Data

Oct. 14, 2015 (KR) ..... 10-2015-0143565

(51) Int. Cl.
*F24F 1/04* (2011.01)
*F24F 1/022* (2019.01)
(Continued)

(52) U.S. Cl.
CPC ..... *F24F 1/04* (2013.01); *F24F 1/005* (2019.02); *F24F 1/0014* (2013.01); *F24F 1/022* (2013.01);
(Continued)

(58) Field of Classification Search
CPC .. F24F 1/04; F24F 1/0014; F24F 1/005; F24F 1/022; F24F 1/0011; F24F 13/105;
(Continued)

(56) References Cited

FOREIGN PATENT DOCUMENTS

CN 101782264 7/2010
CN 101793431 8/2010
(Continued)

OTHER PUBLICATIONS

English Translation of KR-101191416-B1 (Year: 2019).*
(Continued)

*Primary Examiner* — Edward F Landrum
*Assistant Examiner* — Melodee Jefferson
(74) *Attorney, Agent, or Firm* — Staas & Halsey LLP

(57) ABSTRACT

Disclosed herein is an air conditioner configured to implement a convection and radiant cooling effect using a porous panel and an open panel.

An air conditioner comprising a body and a front panel configured to discharge air frontward from the body, wherein the front panel includes a first discharge part formed on at least a part of the front panel and including a plurality of discharge holes formed therein to discharge air a second discharge part formed on at least another part of the front panel and including an opening formed therein to discharge the air; and a rotation unit configured to rotate the front panel so that the air is discharged through at least one of the first discharge part and the second discharge part.

14 Claims, 11 Drawing Sheets

(51) Int. Cl.

| | |
|---|---|
| ***F24F 1/005*** | (2019.01) |
| ***F24F 13/20*** | (2006.01) |
| ***F24F 1/0014*** | (2019.01) |
| ***F24F 13/068*** | (2006.01) |
| ***F24F 13/10*** | (2006.01) |
| ***F24F 13/28*** | (2006.01) |
| ***F24F 13/30*** | (2006.01) |
| ***F24F 13/08*** | (2006.01) |
| ***F24F 13/14*** | (2006.01) |
| ***F24F 1/0011*** | (2019.01) |

(52) U.S. Cl.
CPC ..... *F24F 13/068* (2013.01); *F24F 13/08* (2013.01); *F24F 13/105* (2013.01); *F24F 13/20* (2013.01); *F24F 13/28* (2013.01); *F24F 13/30* (2013.01); *F24F 1/0011* (2013.01); *F24F 2013/1446* (2013.01)

(58) Field of Classification Search
CPC ..... F24F 13/068; F24F 13/08; F24F 13/30; F24F 13/28; F24F 13/20
See application file for complete search history.

(56) References Cited

FOREIGN PATENT DOCUMENTS

| | | |
|---|---|---|
| CN | 203375636 | 1/2014 |
| CN | 203605323 | 5/2014 |
| CN | 204063288 | 12/2014 |
| KR | 2000-0042335 | 7/2000 |
| KR | 20-2009-0000948 | 2/2009 |
| KR | 10-2010-0085441 | 7/2010 |
| KR | 10-2011-0016278 | 2/2011 |
| KR | 10-2011-029870 | 3/2011 |
| KR | 101191416 B1 * | 10/2012 |

OTHER PUBLICATIONS

International Search Report dated Jan. 12, 2017 in corresponding International Patent Application No. PCT/KR2016/011128.
Written Opinion of the International Searching Authority dated Jan. 12, 2017 in corresponding International Patent Application No. PCT/KR2016/011128.
Chinese Office Action dated Jun. 23, 2020 in corresponding Chinese Patent Application No. 201680060050.6.
Chinese Office Action dated Oct. 8, 2019 in Chinese Patent Application No. 201680060050.6.

* cited by examiner

【Fig. 1】
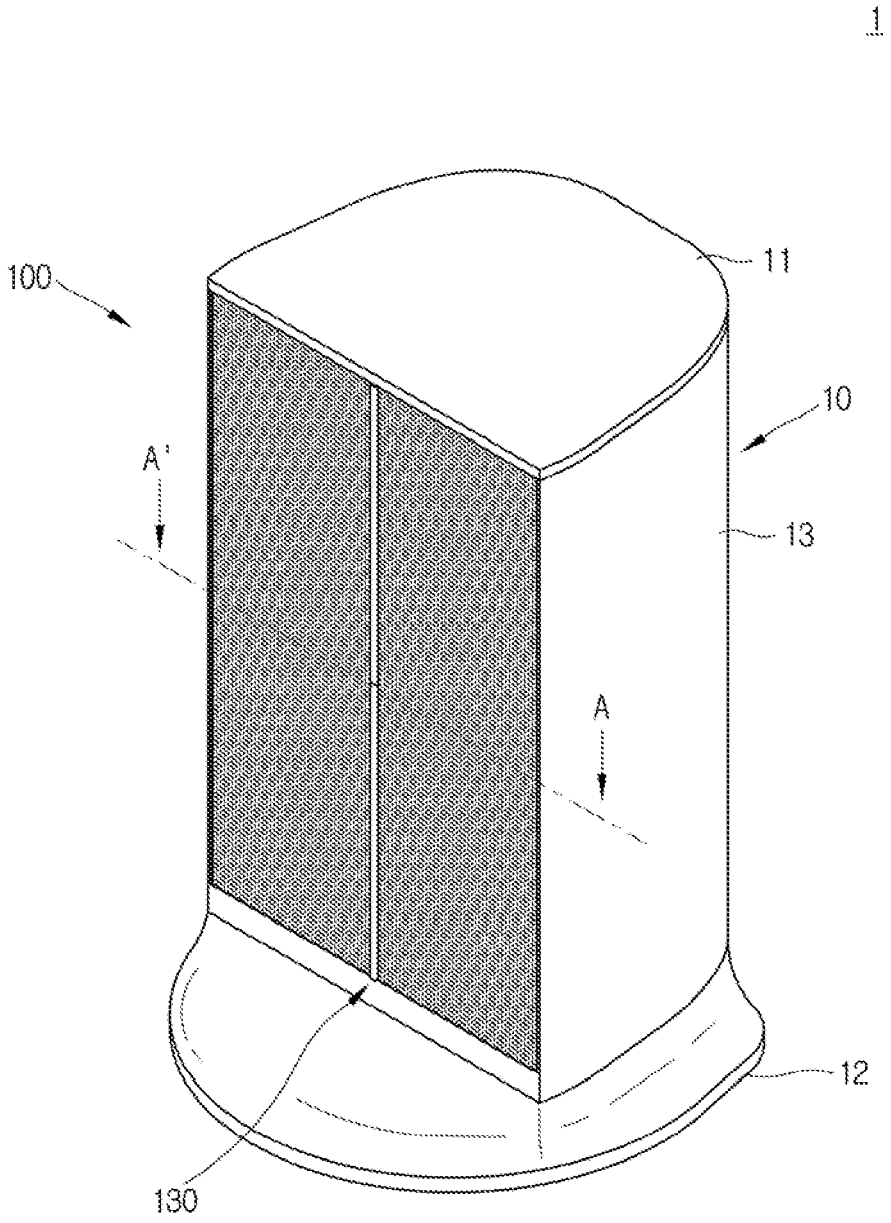

[Fig. 2]
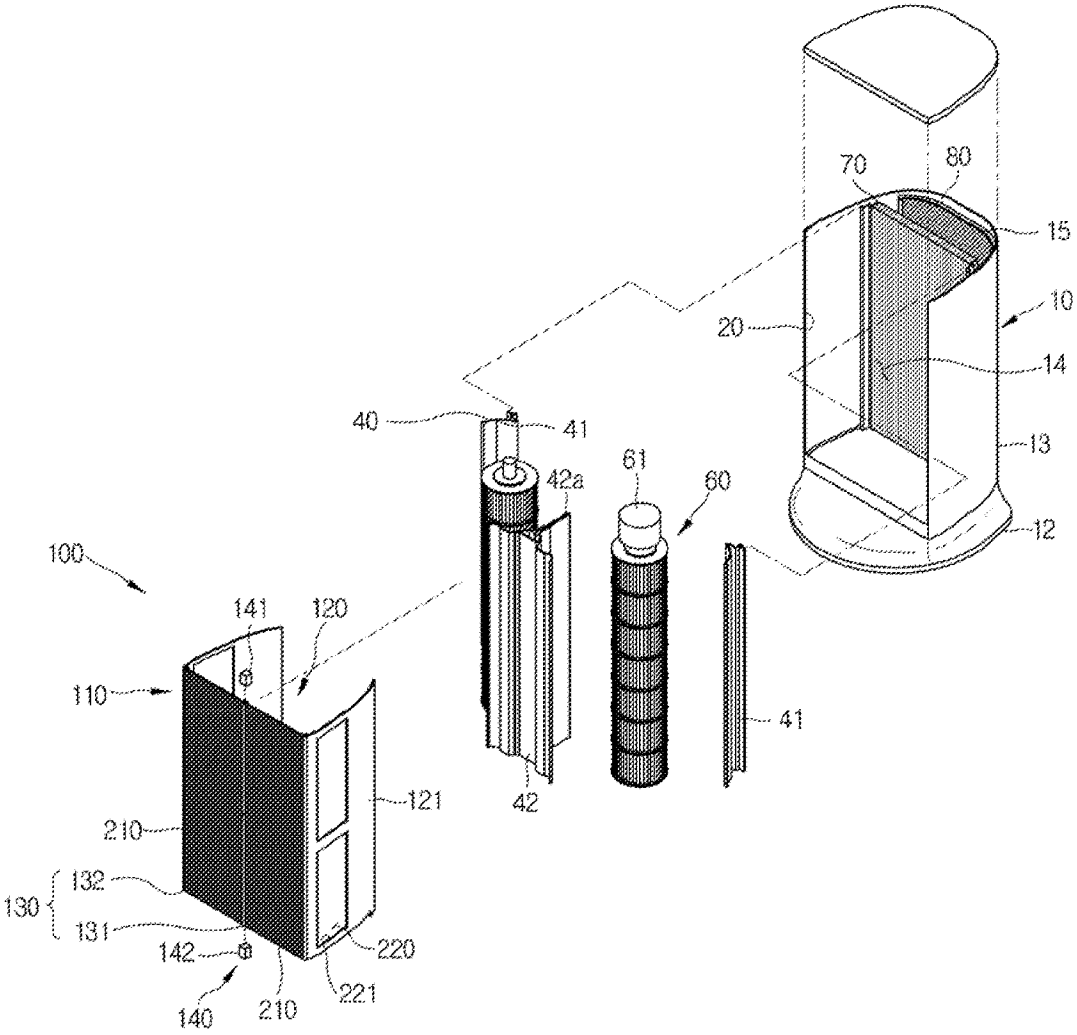

【Fig. 3】
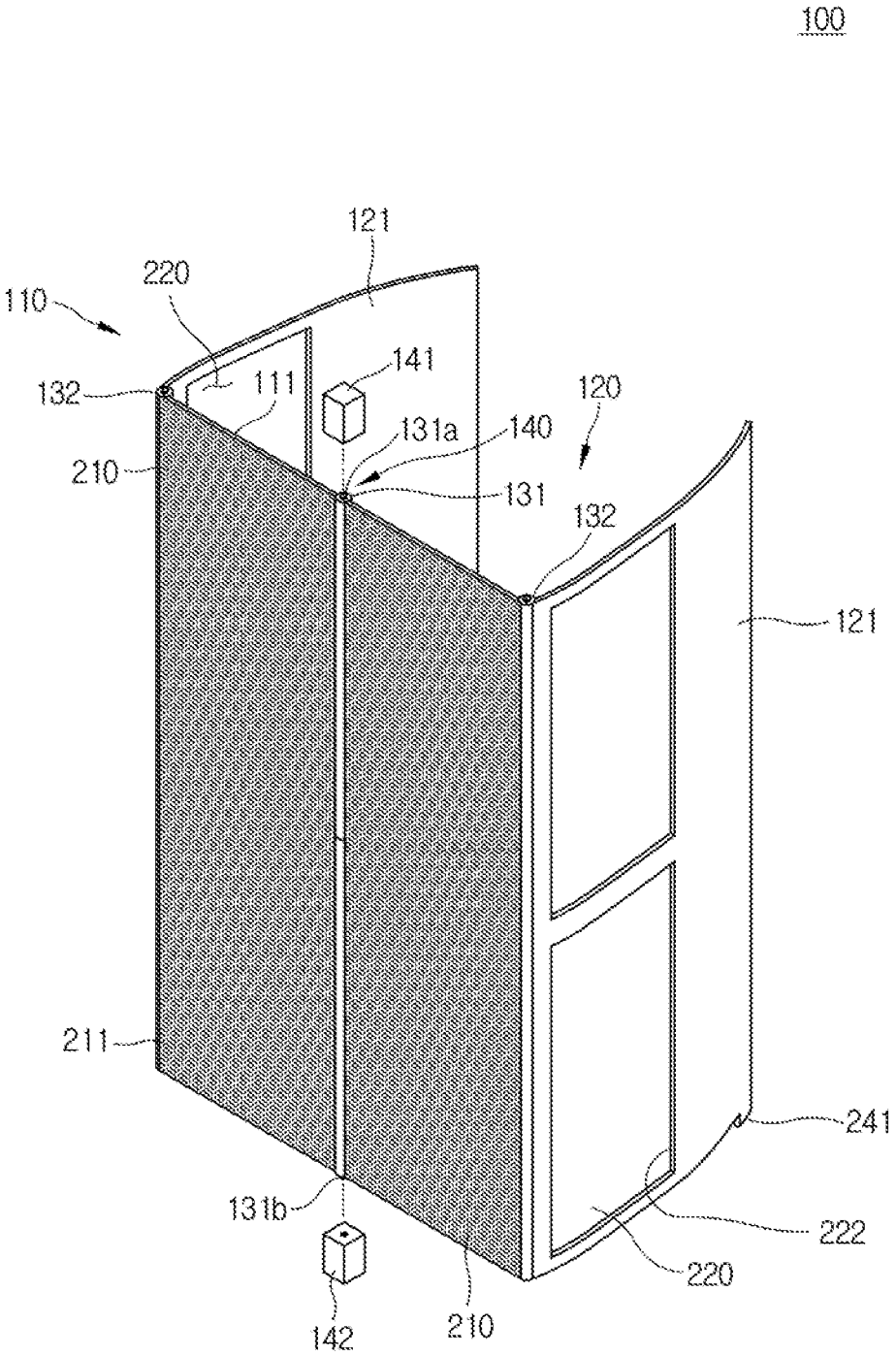

【Fig. 4】
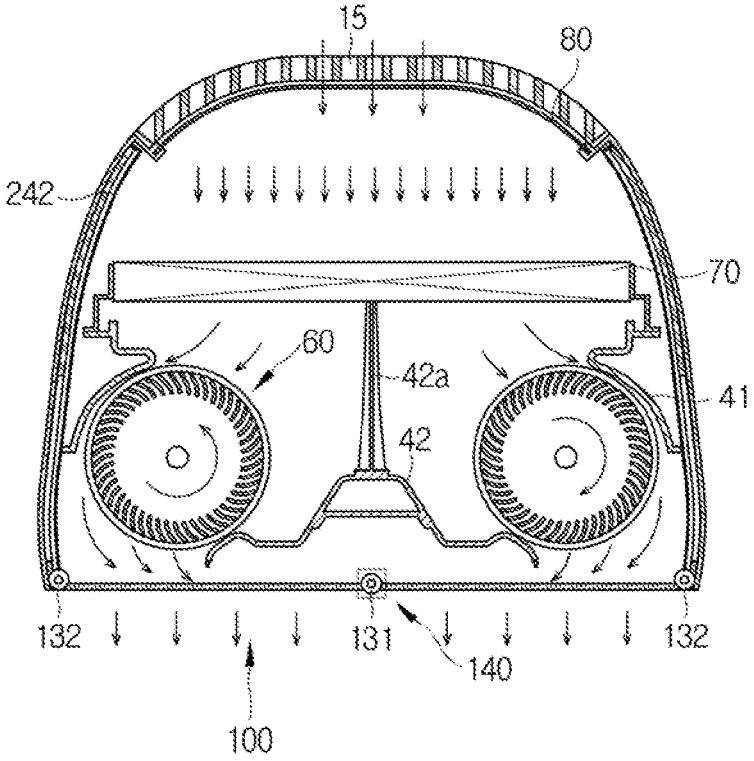

【Fig. 5】
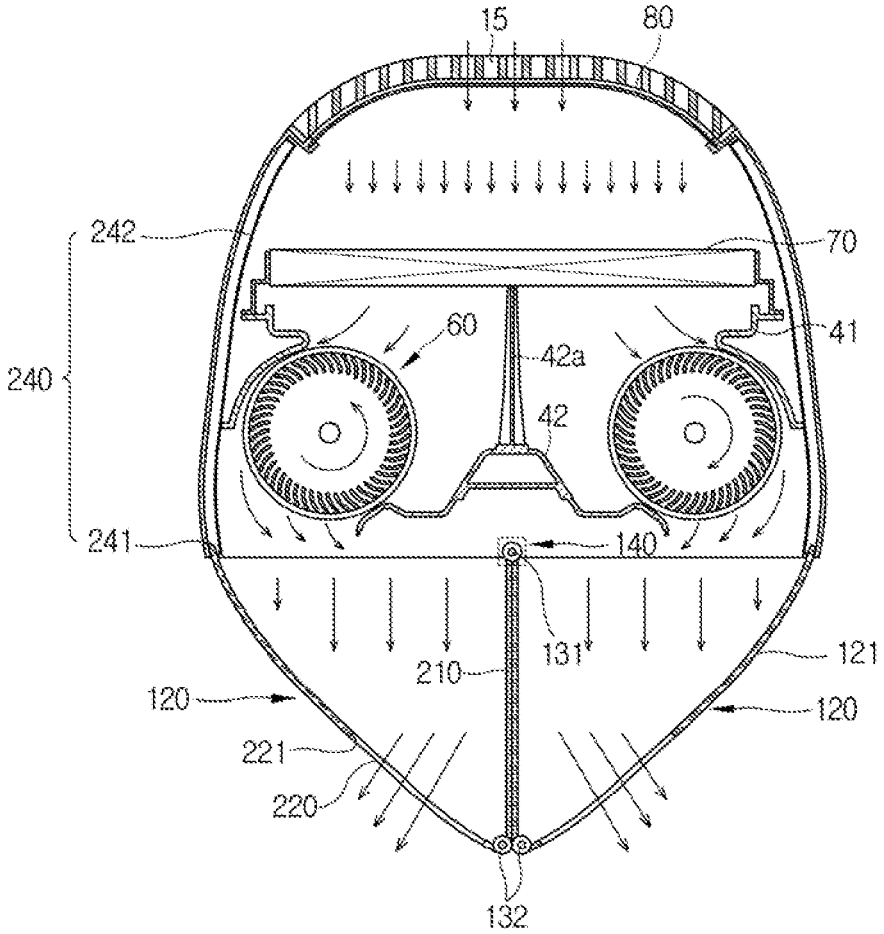

【Fig. 6】
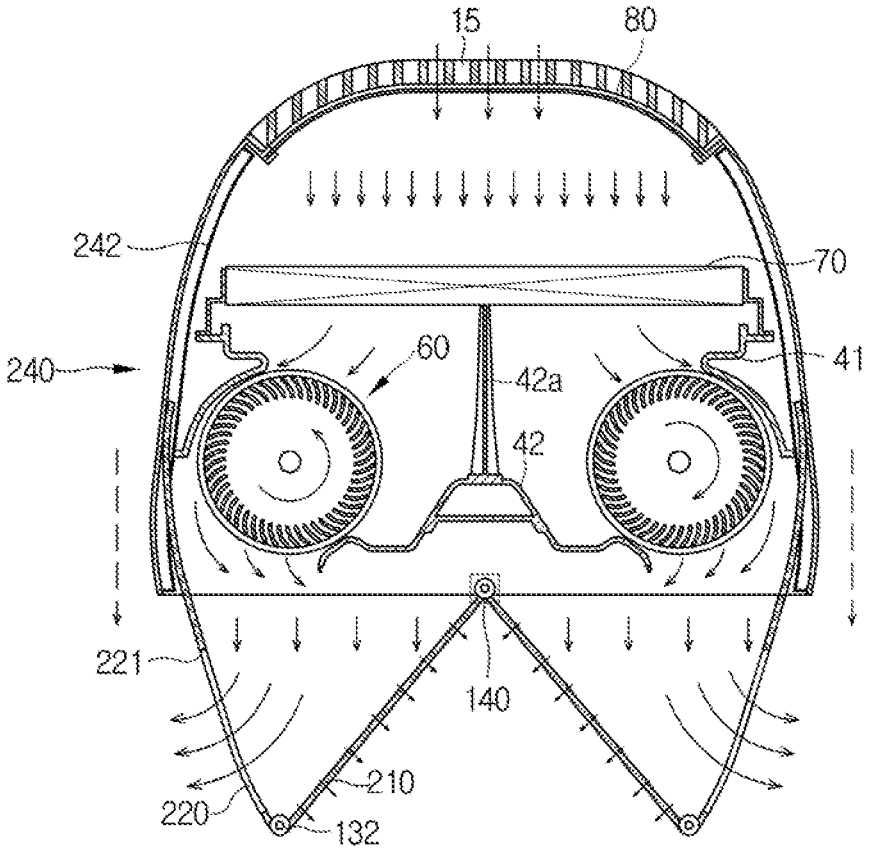

【Fig. 7】
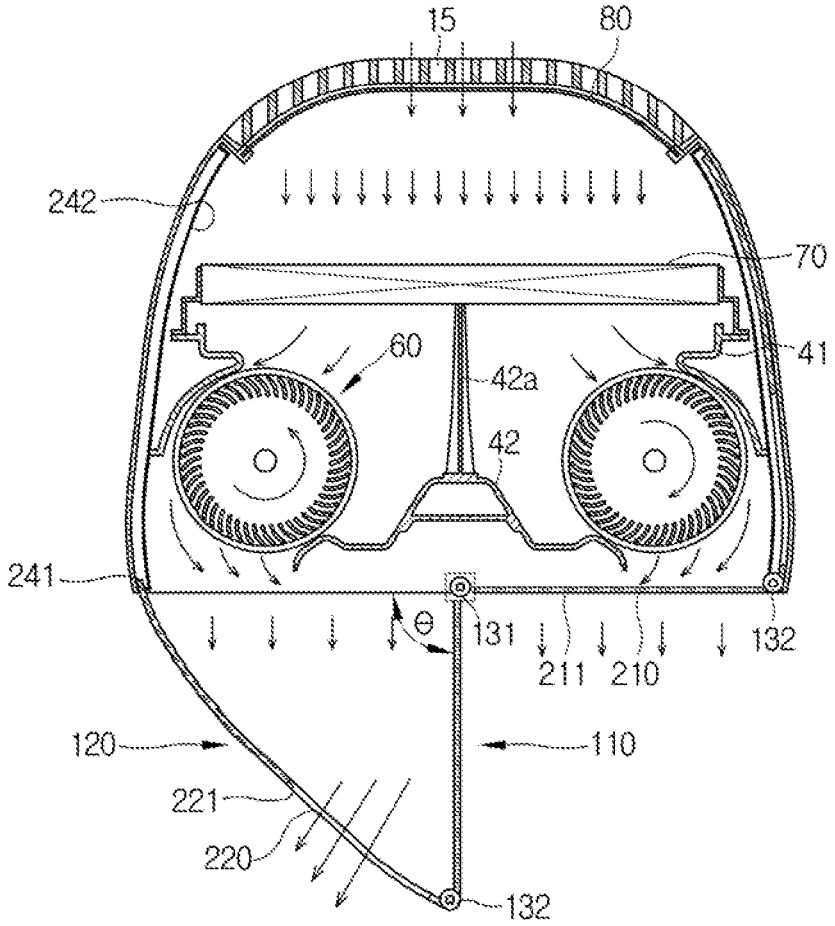

【Fig. 8】
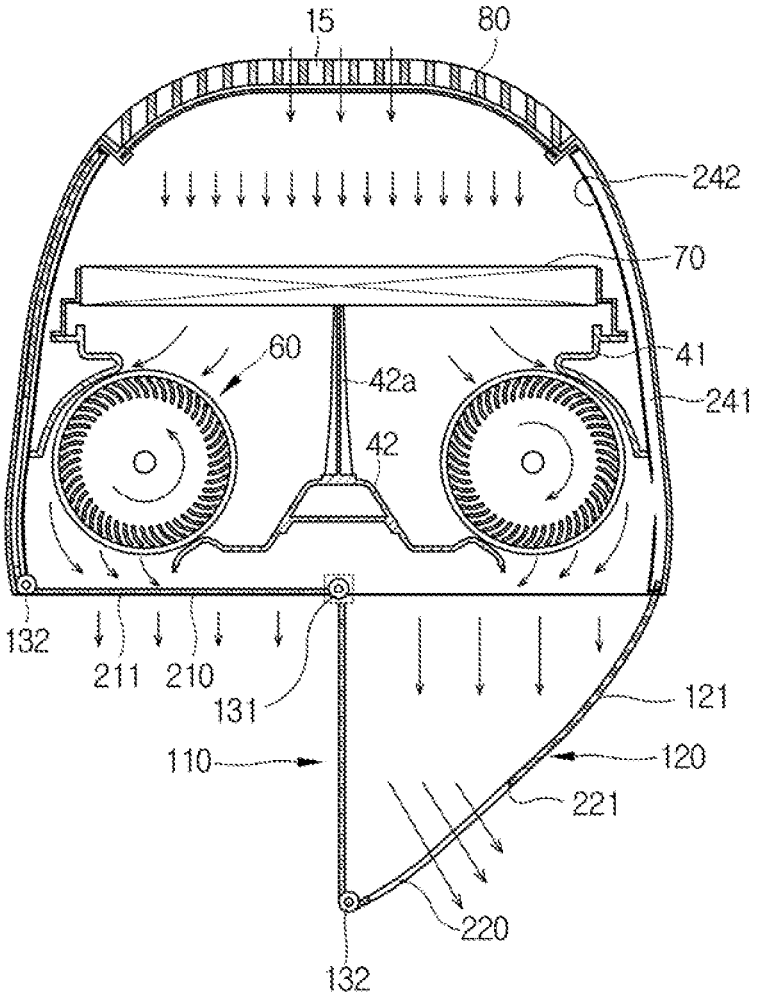

【Fig. 9】
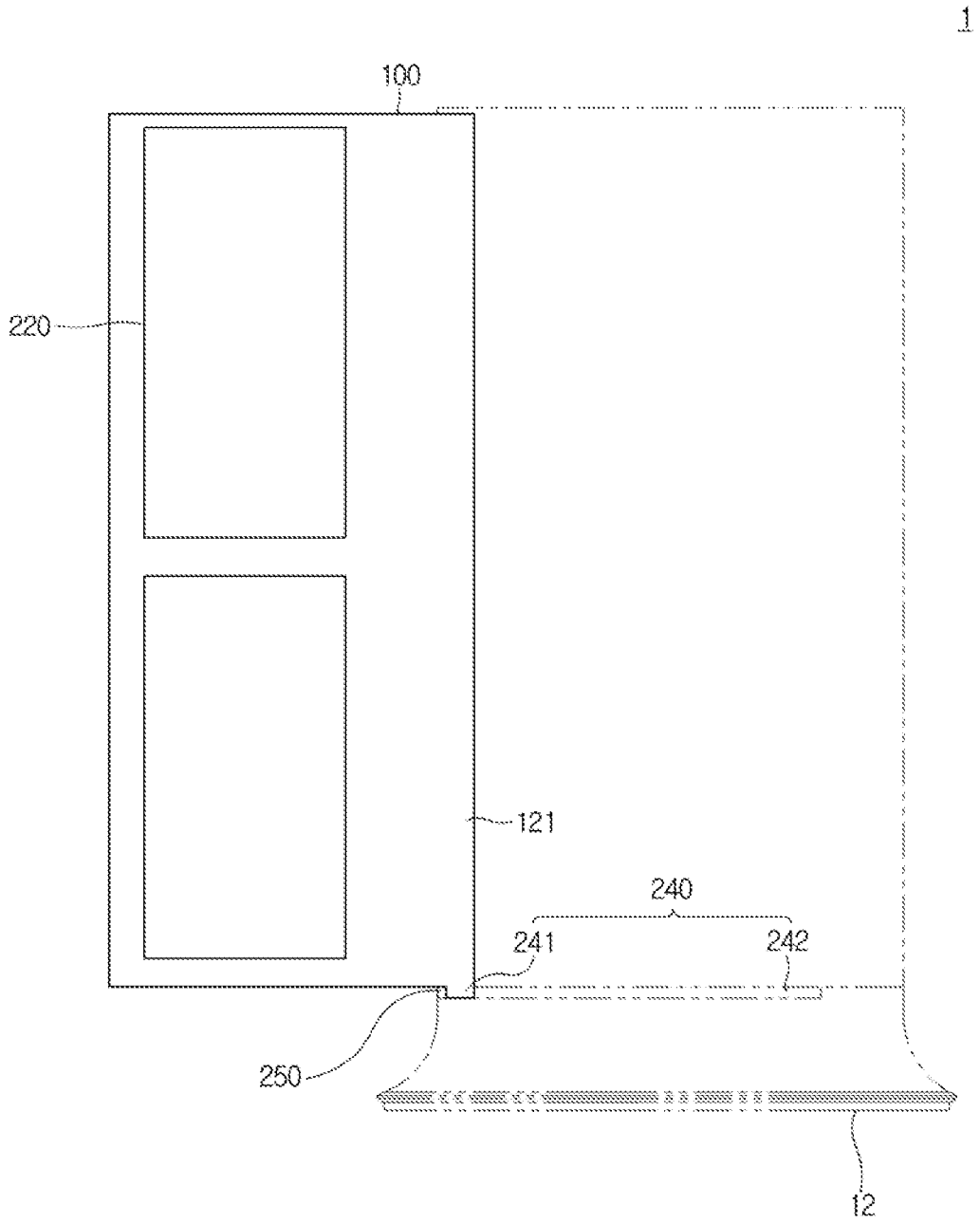

【Fig. 10】
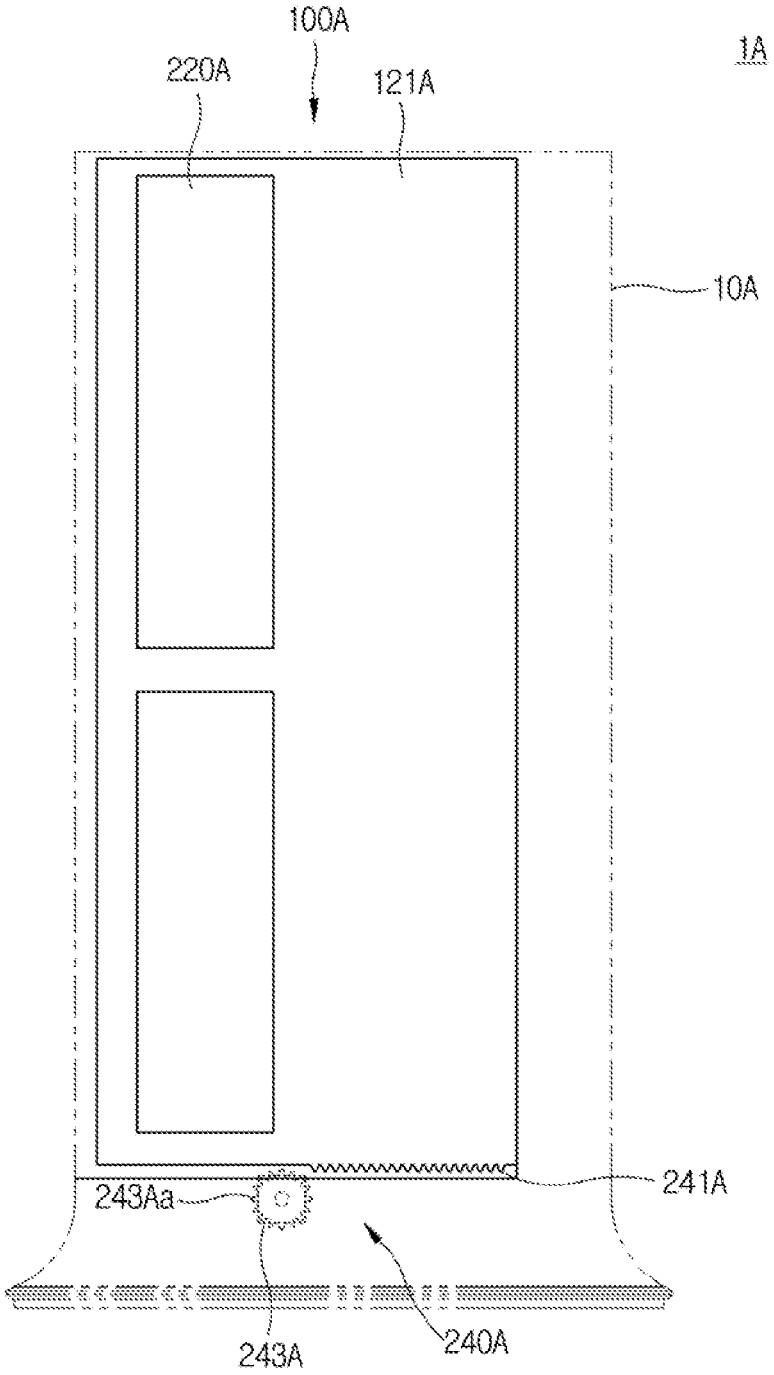

【Fig. 11】
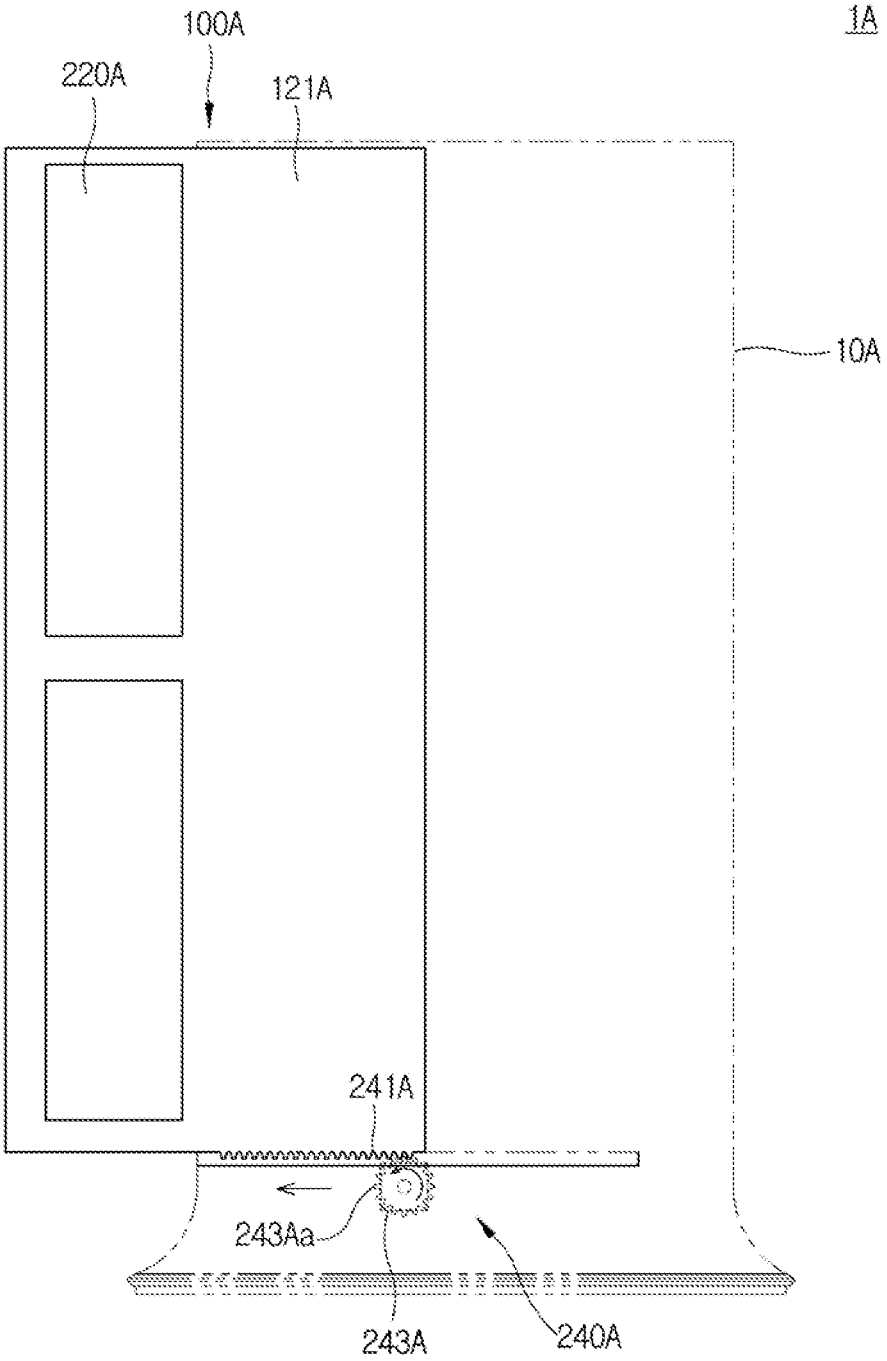

AIR CONDITIONER

CROSS-REFERENCE TO RELATED APPLICATIONS

This application is a National Phase Application under 35 U.S.C. § 371 of PCT International Patent Application No. PCT/KR2016/011128, filed Oct. 5, 2016 which claims foreign priority benefit under 35 U.S.C. § 119 to Korean Patent Application No. 10-2015-0143565 filed Oct. 14, 2015, the contents of which are incorporated herein by reference.

TECHNICAL FIELD

The present disclosure relates to an air conditioner, and more particularly, to an air conditioner configured to implement a convection and radiant cooling effect using a porous panel and an open panel.

BACKGROUND ART

Generally, air conditioners are apparatuses configured to remove dust in air and adjust a temperature, humidity, an air flow, an air distribution, and the like to be suitable for human activity using a refrigeration cycle. The refrigeration cycle includes major components such as a compressor, a condenser, an evaporator, a blowing fan, and the like.

The air conditioner can be classified into a separate type air conditioner in which an indoor unit and an outdoor unit are separately installed, and an integral type air conditioner in which an indoor unit and an outdoor unit are integrally installed in one cabinet. The indoor unit of the separate type air conditioner includes a heat exchanger configured to exchange heat with air introduced into a panel, and a blowing fan configured to suction indoor air into the panel and blow the suctioned air to an indoor space.

In the indoor unit of the air conditioner, air suctioned and blown by the blowing fan flows in the indoor unit and is discharged to an indoor space through the heat exchanger and an air discharge port. In this case, since the indoor unit has to be disposed in upward and downward directions or frontward and rearward directions due to the blowing fan and the heat exchanger, space utilization of the indoor unit is inefficient.

DISCLOSURE

Technical Problem

One aspect of the present disclosure provides an air conditioner configured to implement a convection and radiant cooling effect using a porous panel and an open panel.

Another aspect of the present disclosure provides an air conditioner configured to directly blow discharged air to a user or capable of selectively adjusting to directly blow discharged air to the user.

Technical Solution

In accordance with an aspect of the present disclosure, an air conditioner includes: a body; and a front panel configured to discharge air frontward from the body, wherein the front panel includes: a first discharge part formed on at least a part of the front panel and including a plurality of discharge holes formed therein to discharge air; a second discharge part formed on at least another part of the front panel and including an opening formed therein to discharge the air; and a rotation unit configured to rotate the front panel so that the air is discharged through at least one of the first discharge part and the second discharge part.

The rotation unit may include a first rotation part provided so that the front panel is rotated with respect to the body, and a second rotation part provided so that the first discharge part and the second discharge part are rotated relative to each other.

The front panel may include a first panel in which the first discharge part and the second discharge part are provided, and a second panel provided to correspond to the first panel, and the first panel and the second panel may be rotated by the first rotation part.

The first panel and the second panel may be rotated with respect to the first rotation part so that the air is discharged through at least one of the first discharge part and the second discharge part.

The first discharge part may include at least one of a mesh and a porous material.

The rotation unit may include a driving part configured to rotate the front panel.

The driving part may be connected to the first rotation part.

The driving part may include a first motor connected to the first panel and a second motor connected to the second panel.

The driving part may be provided to control a rotation angle of each of the first panel and the second panel.

The air conditioner may include a guide part provided to guide movement of the front panel, wherein the guide part may include a first guide provided in the second discharge part and a second guide provided in the body to correspond to the first guide.

The second guide may include a stopper configured to restrict movement of the second discharge part.

The guide part may further include a gear provided on the second panel and a guide motor engaged with the gear.

Advantageous Effects

Since an air conditioner according to one aspect of the present disclosure can discharge heat-exchanged air at different velocities of the air using a porous panel and an open panel, a convection and radiant cooling effect can be implemented.

Further, since a user can select whether heat-exchanged air is directly blown to the user or not blown to the user, user satisfaction can be improved.

Further, since a velocity and direction of discharged air can be increased due to a compact path configuration, cooling performance of an air conditioner can be improved.

DESCRIPTION OF DRAWINGS

FIG. 1 is a perspective view illustrating an air conditioner according to one embodiment of the present disclosure.

FIG. 2 is an exploded perspective view illustrating the air conditioner according to one embodiment of the present disclosure.

FIG. 3 is a perspective view illustrating a front panel of the air conditioner according to one embodiment of the present disclosure.

FIG. 4 is a cross-sectional view taken along a line A-A' in FIG. 1, showing a state in which air is discharged through a first discharge part of a front panel according to an embodiment of the present invention.

FIG. 5 is a view illustrating a state in which air is discharged through a second discharge part in a state where a first discharge panel of a front panel according to an embodiment of the present invention is rotated.

FIG. 6 is a view illustrating a state in which air is simultaneously discharged through a first discharge part and a second discharge part in a state where a front panel is rotated at a predetermined angle according to an embodiment of the present invention.

FIG. 7 is a view illustrating a state in which air is discharged through a second discharge part of a first panel and a first discharge part of a second panel according to an embodiment of the present invention, FIG. 8 is a view showing a state in which air is discharged through a first discharge part of a first panel and a second discharge part of a second panel according to an embodiment of the present invention, FIG. 9 is a schematic view illustrating an operation of a guide part configured to guide movement of the front panel according to one embodiment of the present disclosure.

FIG. 10 is a schematic view illustrating a guide part configured to guide movement of a front panel according to another embodiment of the present disclosure, FIG. 11 is a schematic view an operation of the guide part configured to guide the movement of the front panel according to another embodiment of the present disclosure.

MODES OF THE DISCLOSURE

Embodiments described in the specification and configurations shown in the accompanying drawings are merely exemplary examples of the present disclosure, and various modifications may replace the embodiments and the drawings of the present disclosure at a time at which the present application is filed.

Further, identical symbols or numbers in the drawings of the present disclosure denote components or elements configured to perform substantially identical functions.

Further, terms used herein are only for the purpose of describing particular embodiments and are not intended to limit the present disclosure. The singular form is intended to also include the plural form, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," and the like may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed items.

Hereinafter, embodiments according to the present disclosure will be described in detail with reference to the accompanying drawings.

A refrigeration cycle forming an air conditioner includes a compressor, a condenser, an expansion valve, and an evaporator. The refrigeration cycle includes a series of cycles including compression, condensation, expansion, and evaporation, and after hot air is heat-exchanged with a cold refrigerant, the refrigeration cycle supplies cold air to an indoor space.

The compressor compresses a refrigerant gas in a high temperature and high pressure state and then discharges the refrigerant gas, and the discharged refrigerant gas is introduced into the condenser. The condenser condenses the compressed refrigerant into a liquid state, and releases heat to its surroundings through a condensation process. The expansion valve expands the liquid refrigerant in the high temperature and high pressure state condensed by the condenser to a liquid refrigerant in a low pressure state. The evaporator evaporates the refrigerant expanded by the expansion valve. The evaporator achieves a refrigeration effect due to exchanging heat between an object which is cooled and the refrigerant using evaporative latent heat of the refrigerant, and returns the refrigerant gas to the compressor in a low temperature and low pressure state. An indoor air temperature may be adjusted by the above-described cycle.

An outdoor unit of the air conditioner is a part including the compressor and an outdoor heat exchanger among the refrigeration cycle. The expansion valve may be in one of the indoor unit and the outdoor unit, and an indoor heat exchanger is in the indoor unit of the air conditioner.

The embodiment of the present disclosure relates to an air conditioner configured to cool an indoor space, an outdoor heat exchanger serves as a condenser, and an indoor heat exchanger serves as an evaporator. Hereinafter, for convenience, the indoor unit including the indoor heat exchanger will be referred to as an air conditioner, and the indoor heat exchanger will be referred to as a heat exchanger.

FIG. 1 is a perspective view illustrating an air conditioner according to one embodiment of the present disclosure, FIG. 2 is an exploded perspective view illustrating the air conditioner according to one embodiment of the present disclosure, and FIG. 3 is a perspective view illustrating a front panel of the air conditioner according to one embodiment of the present disclosure.

As shown in FIGS. 1 to 3, an air conditioner 1 includes a body 10 forming an exterior of the air conditioner 1, and a front panel 100 coupled to a front of the body 10 and forming a front surface of the air conditioner 1.

In the body 10, a heat exchanger 70 configured to exchange heat with air introduced into the body 10, blowing fans 60 configured to forcibly circulate air to the inside or the outside of the body 10, and a path guide 40 configured to guide a flow of air in the body 10 may be provided.

The body 10 may include a base 12 including at least one opening portion 20 and forming a bottom, a rear panel 13 disposed on a rear of the base 12, and an upper panel 11 forming an upper surface of the rear panel 13. The front panel 100, which is provided so that heat-exchanged air may be discharged, may be disposed in the opening portion 20 of the body 10. A containing portion 14 is formed between the base 12, the upper panel 11, the rear panel 13, and the front panel 100 of the body 10.

In the embodiment of the present disclosure, although an example in which the rear panel is integrally formed with both side surfaces is shown, the spirit of the present disclosure is not limited thereto. For example, the rear panel may be formed separately from both of the side surfaces to be assembled. The rear panel 13 may be formed in a curved surface shape protruding rearward, and may be formed in an approximately circular shape.

A suction port 15 configured to suction air into the body 10 may be provided in the rear panel 13. The suction port 15 is formed in an approximately rectangular shape, and is located in an upper portion of a rear surface of the body 10 to suction air around the suction port 15 into the body 10. A filter 80 is installed inside the suction port 15 and filters fine impurities and the like from the air introduced through the suction port 15.

The heat exchanger 70 configured to exchange heat with the air introduced through the suction port 15 may be installed in an inner portion of the body 10 close to the suction port 15.

The heat exchanger 70 is formed in a rectangular shape vertically extending by a predetermined length to correspond to the suction port 15, and absorbs heat of air suctioned through the suction port 15 to discharge the air outward from the body 10 through the front panel 100.

The heat exchanger 70 may include a tube (not shown) and a header (not shown). A type of the heat exchanger 70 is not limited. The number of heat exchangers 70 disposed inside the body 10 may correspond to the number of openings and be at least one.

The blowing fans 60 are vertically elongated in an approximately cylindrical shape to smoothly blow air which passed through the suction port 15 and the heat exchanger 70, and are rotatably installed at laterally symmetrical locations in the body 10.

A driving motor 61 is coupled to one end of each of the blowing fans 60 and rotates the blowing fan 60. In the embodiment of the present disclosure, since a rotary shaft of the blowing fan 60 and a plane through which the air suctioned through the suction port 15 flows are perpendicular to each other, the blowing fan 60 may be referred to as a cross-flow fan.

The path guide 40 may be provided at both sides of the body 10 so that air which passes through the blowing fans 60 may be smoothly discharged in a forward direction.

The path guide 40 includes first path guides 41 formed in a shape surrounding the blowing fans 60, and a second path guide 42 configured to guide air guided by the first path guides 41 so that the air is discharged toward the front panel 100.

The first path guides 41 may be symmetrically provided at both sides of the body 10.

The second path guide 42 may be provided between the first path guides 41.

The second path guide 42 may include a partition member 42*a* formed to protrude rearward from the second path guide 42. The partition member 42*a* serves to partition a space formed between the blowing fans 60 so that the air heat-exchanged through the heat exchanger 70 may be blown by only one of the blowing fans 60 disposed at both sides of the inside of the body 10.

The partition member 42*a* of the second path guide 42 is configured to prevent interference generated between the blowing fans 60 symmetrically installed at both sides of the body 10. For example, when the partition member 42*a* does not exist, since air between the blowing fans 60 located at both sides of the body 10 is influenced by both of the blowing fans 60 and may not be smoothly discharged to the front panel 100, and air which is closer to one blowing fan 60 than the other is influenced by the other blowing fan 60, smooth discharge of the air blown by the blowing fans 60 may be interrupted.

Accordingly, the partition member 42*a* of the second path guide 42 allows the air which passed the heat exchanger 70 in the body 10 to smoothly flow through a path and improves blowing efficiency of the blowing fan 60.

It should be apparent that the partition member 42*a* may not be installed when a width of the inside of the body 10 is large and an interval between the blowing fans 60 increases such that interference between the blowing fans 60 almost does not exist.

Meanwhile, the front panel 100 may be installed in the opening portion 20 of in the front of the body 10. The front panel 100 may include a first panel 110 and a second panel 120 disposed at a left side and a right side, respectively.

The first panel 110 and the second panel 120 may be symmetrically installed at the left side and the right side of the front of the body 10. The first panel 110 and the second panel 120 is provided so that the air heat-exchanged in the body 10 is discharged outward from the body 10. Each of the first panel 110 and the second panel 120 may include a first discharge part 210 and a second discharge part 220.

The first discharge part 210 may be provided in each of the first panel 110 and the second panel 120. The first discharge part 210 may be formed in at least a part of each of the first panel 110 and the second panel 120. The first discharge parts 210 may be symmetrically formed on the basis of a central portion between the first panel 110 and the second panel 120.

The first discharge part 210 may include a plurality of discharge holes 211.

The first discharge part 210 may include at least one of a mesh and a porous material. The plurality of discharge holes 211 forming the first discharge part 210 may be formed to be uniformly distributed in at least a part of the first panel 110.

Each of the first discharge parts 210 may include a first discharge panel 111 including the discharge holes 211. The first discharge panel 111 may include a porous panel formed from the plurality of uniformly distributed discharge holes 211.

Further, the plurality of discharge holes 211 may be intensively formed in at least a part of the first discharge panel 111. In the embodiment, an example in which the plurality of discharge holes in the first discharge part are uniformly distributed is shown.

The second discharge part 220 may be rotatably provided on the first discharge part 210. Each of the second discharge part 220 may include openings 221 so that the air heat-exchanged in the body 10 may be discharged outward from the body 10. The openings 221 may be formed in at least a part of the first panel 110. The openings 221 may be formed to pass through an upper portion and a lower portion of the first panel 110 with a predetermined width. In the embodiment, although an example in which the opening of the second discharge part is formed to be partitioned is shown, the spirit of the present disclosure is not limited thereto. For example, the opening of the first discharge part may be formed to pass through at least a part of the first panel in a vertical direction.

The second discharge part 220 may include a second discharge panel 121 configured to extend from each of the first discharge parts 210. The second discharge part 220 may include the openings 221 formed to pass through at least a part of the second discharge panel 121.

The first discharge panel 111 and the second discharge panel 121 may be provided to be rotatable by a second rotation part 132, which will be described below. In the embodiment of the present disclosure, although an example in which the first discharge panel 111 and the second discharge panel 121 are integrally provided to extend with respect to the second rotation part 132 is shown, the spirit of the present disclosure is not limited thereto. For example, the first discharge panel including the first discharge part and the second discharge panel including the second discharge part may be separately provided to be coupled by a second hinge.

The first discharge part 210 and the second discharge part 220 may be provided to be rotatable due to the second rotation part 132. The first discharge part 210 and the second discharge part 220 are provided to be rotatable relative to each other around the second rotation part 132.

Meanwhile, the first panel 110 may be installed to be rotatable with respect to the body 10. The first panel 110 may include a rotation unit 130 configured to rotate the first panel 110 so that air may be discharged through at least one of the first discharge part 210 and the second discharge part 220.

The rotation unit 130 may include a first rotation part 131 on which the first panel 110 is provided to be rotated with respect to the body 10, and the second rotation part 132 provided between the first discharge part 210 and the second discharge part 220 so that the first discharge part 210 and the second discharge part 220 are rotated relative to each other.

The first rotation part 131 is provided between the first panel 110 and the second panel 120 so that the first panel 110 and the second panel 120 are rotatable in a frontward direction with respect to the body 10. The first rotation part 131 may be disposed at a central portion between the openings 221 of the body 10. The first panel 110 and the second panel 120 may be rotated around the first rotation part 131 in directions toward the front and rear of the body 10.

The rotation unit 130 may further include a driving part 140 provided to rotate the first panel 110 and the second panel 120. The driving part 140 may be connected to the first rotation part 131. The driving part 140 may be connected to the first rotation part 131 to rotate the first panel 110 and the second panel 120 toward the front of the body 10.

The first rotation part 131 may include a first rotary shaft 131*a* formed to be connected to the first panel 110 and a second rotary shaft 131*b* formed to be connected to the second panel 120.

The driving part 140 may include a first motor 141 configured to rotate the first panel 110 and a second motor 142 configured to rotate the second panel 120. The first motor 141 is connected to the first rotary shaft 131*a* of the first panel 110. The first motor 141 may be connected to the first rotary shaft 131*a* to rotate the first panel 110. The second motor 142 is connected to the second rotary shaft 131*b* of the second panel 120. The second motor 142 may be connected to the second rotary shaft 131*b* to rotate the second panel 120.

Since the first motor 141 controls an angle of the rotation of the first panel 110 and the second motor 142 controls an angle of the rotation of the second panel 120, angles of air discharged from the first discharge part 210 and the second discharge part 220 due to the rotation of the first discharge panel 111 and the second discharge panel 121 may be controlled.

Further, a flow of the discharged air may be controlled by changing a flow of the air discharged through the first discharge part 210 and the second discharge part 220 due to the angles of the rotation of the first discharge panel 111 and the second discharge panel 121. In addition, the first motor 141 and the second motor 142 may control directions of the air discharged through the first discharge part 210 and the second discharge part 220 by controlling the angles of the rotation of the first panel 110 and the second panel 120.

The first discharge panel 111 and the second discharge panel 121 may be connected to be rotatable relative to each other by the second rotation part 132. The first discharge part 210 and the second discharge part 220 are provided to be rotatable relative to each other by the second rotation part 132. The second rotation part 132 rotatably connects the first discharge panel 111 and the second discharge panel 121.

As described above, in the air conditioner 1 according to one embodiment of the present disclosure, since the suction port 15, the heat exchanger 70, the blowing fans 60, and the front panel 100 for discharging the air are sequentially disposed in parallel from the rear of the body 10 to the front of the body 10, a volume of a path through which the air suctioned into the body 10 flows until it is discharged is decreased, and a distance between the suction port 15 and the front panel 100 is decreased.

Since the air suctioned into the body 10 is blown through a short path by the blowing fans 60 in a state in which almost no resistance of the path is received and the air is discharged through the first discharge part 210 and the second discharge part 220 of the front panel 100, a large amount of air may be discharged without increasing the number of rotations of the blowing fans 60 and a volume and velocity of the discharged air may be efficiently controlled.

Hereinafter, a process in which air is suctioned and discharged through a configuration like above, and a principle of the first discharge part and the second discharge part of the front panel configured to control an amount and direction of the discharged air will be described in detail.

As shown in FIG. 4, the first discharge panels 111 of each of the first panel 110 and the second panel 120 disposed at both sides of the front of the body 10 are disposed in parallel to correspond to the openings 221 of the body 10.

In this case, the second discharge panel 121 is disposed in the body 10.

The heat-exchanged air in the body 10 may be discharged toward the front of the body 10 through first discharge parts 210 of each of the first panel 110 and the second panel 120. The velocity of the heat-exchanged air may be decreased through the plurality of discharge holes 211 formed in the first discharge part 210, and thus the heat-exchanged air may be discharged outward from the body 10 at low velocity.

As shown in FIG. 5, the first panel 110 and the second panel 120 disposed at both sides of the front of the body 10 are rotated frontward from the openings of the body 10.

The first panel 110 is rotated by the first motor 141, and the second panel 120 is rotated by the second motor 142. The first discharge panels 111 of each of the first panel 110 and the second panel 120 are rotated around the first rotation part 131 and disposed to be perpendicular to the openings 221 of the body 10.

The second discharge panel 121 connected to the first discharge panel 111 by the second rotation part 132 is rotated toward the front of the body 10 to be moved according to the rotation of the first discharge panel 111.

The second discharge panels 121 of the first panel 110 and the second panel 120 are rotated relative to the first discharge panels 111 to be moved to the front of the body 10.

The second discharge part 220 of the second discharge panel 121 is exposed outward from the body 10.

The heat-exchanged air in the body 10 is discharged through the second discharge part 220 of the second discharge panel 121. A velocity of the heat-exchanged air may be increased via the openings 221 formed in the second discharge part 220 such that the heat-exchanged air may be discharged outward from the body 10 at high velocity.

FIGS. 6 to 8 are views illustrating an air discharge operation of the first discharge part and the second discharge part according to rotation of the front panel.

As shown in FIGS. 6 to 8, since rotation angles θ of the first discharge panel 111 and the second discharge panel 121 are variously changed to adjust locations of the first discharge part 210 and the second discharge part 220, a volume, a velocity, and a direction of the discharged air may be variously controlled.

For example, the air may be discharged in a lateral direction at high velocity from a left side of the air conditioner 1 through the openings 221 of the second discharge part 220, and may be discharged in the frontward direction at low velocity from a right side of the air conditioner 1 through the first discharge part 210 by rotating only the first discharge panel 111 and leaving the second discharge panel 121.

Further, on the other hand, the air may be discharged in the frontward direction at low velocity from the left side of the air conditioner 1 through the first discharge part 210, and may be discharged in the lateral direction at high velocity from the right side of the air conditioner 1 through openings 221 of the second discharge part 220 by rotating only the second discharge panel 121 and leaving the first discharge panel 111.

Since a rotation angle of the front panel 100, that is, the rotation angles of the first discharge part 210 and the second discharge part 220, is controlled using the above-described configuration and principle, a user may easily and conveniently adjust indoor air to be in a preferable state.

FIG. 9 is a schematic view illustrating an operation of a guide part configured to guide movement of the front panel according to one embodiment of the present disclosure.

As shown in FIG. 9, the front panel 100 may include guide parts 240 configured to guide movement thereof.

The guide parts 240 may be formed on the second discharge panels 121 of each of the first panel 110 and the second panel 120. The guide parts 240 are provided to guide movement of the second discharge panel 121 from the inside of the body 10 to the outside of the body 10.

Each of the guide parts 240 may include a first guide 241 provided in the second discharge panel 121 and a second guide 242 provided in the body 10 to correspond to the first guide 241.

The first guide 241 may be formed to protrude from a lower rear end of the second discharge panel 121. The second guide 242 may be elongated in frontward and rearward directions with respect to the air conditioner 1 at both sides of the inside of the body 10 to correspond to the first guide 241. The second guide 242 may include at least one among a groove, a slot, and a rail formed to be recessed toward a lower side of the body 10.

The first guide 241 may be moved along the second guide 242 in directions toward the front and the rear of the body 10. That is, the second discharge panel 121 in which the first guide 241 is formed may be moved along the second guide 242 in the directions toward the front and the rear of the body 10.

In this case, the second discharge panel 121 performs a relative rotation by the rotational movement of the first discharge panel 111 and is linked with the first discharge panel 111 to be moved.

Meanwhile, the guide part 240 may further include a stopper 250 provided to restrict movement of the second discharge panel 121. The stopper 250 may be provided in the second guide 242. The stopper 250 may be provided in a front end portion of the second guide 242 to restrict forward movement of the first guide 241. The stopper 250 may be disposed inside the openings 221 of the body 10. The stopper 250 restricts the movement of the first guide 241 to prevent the second discharge panel 121 from being separated outward from the body 10.

The guide parts 240 may be provided on at least one of an upper end and a lower end of the second discharge panel 121. In the embodiment, although an example in which the guide parts are provided on a lower end of the second panel and in a lower portion of the containing portion of the body is shown, the spirit of the present disclosure is not limited thereto. For example, the guide parts may be provided on an upper end of the second panel and in an upper panel of the body.

FIG. 10 is a schematic view illustrating a guide part configured to guide movement of a front panel according to another embodiment of the present disclosure, and FIG. 11 is a schematic view an operation of the guide part configured to guide the movement of the front panel according to another embodiment of the present disclosure. Reference numerals not shown may be understood with reference to FIGS. 1 to 9.

As shown in FIGS. 10 and 11, an air conditioner 1A according to another embodiment of the present disclosure may include guide parts 240A configured to guide movement of a front panel 100.

The air conditioner 1A includes a body 10A, and the front panel 100 installed in an opening portion 20 in a front of the body 10A. The front panel 100 includes a first discharge panel 111 and a second discharge panel 121A, and when being moved by rotation of the first discharge panel 111, the second discharge panel 121A rotated relative to the first discharge panel 111 is guided by the guide parts 240A to be moved in directions toward the front and rear of the body 10A.

In this case, each of the guide parts 240A provided to guide the movement of the second discharge panel 121A may include a gear 241A formed on the second discharge panel 121A and a guide motor 243A provided inside a containing portion 14 of the body 10A to be engaged with the gear 241A of the second discharge panel 121A.

The guide motor 243A may include a rotation gear 243Aa corresponding to the gear 241A of the second discharge panel 121A to be engaged with the gear 241A. Accordingly, when the guide motor 243A is rotated, the gear 241A of the second discharge panel 121A is moved in frontward and rearward directions by rotation of the rotation gear 243Aa.

As described above, since the second discharge panel 121A is moved in the frontward and rearward directions by power of the guide motor 243A, rotational movement of the first discharge panel 111 rotated relative to the second discharge panel 121A may be smoothed, and thus convenience for user may be further improved.

Although the embodiments are disclosed to facilitate the understanding of the present disclosure described above, those skilled in the art should understand that the present disclosure is not limited to the particular embodiments described above, and the embodiments may be variously transformed, modified, and replaced without departing from the scope of the present disclosure.

The invention claimed is:

1. An air conditioner comprising:

a body; and a front panel including:

a first panel including a first discharge panel having a plurality of discharge holes formed therein to discharge air from inside the body, and a second discharge panel having an opening formed therein to discharge air from inside the body; and a second panel including a first discharge panel having a plurality of discharge holes formed therein to discharge air from inside the body, and a second discharge panel having an opening formed therein to discharge air from inside the body, wherein the first panel is configured to be rotatable with respect to the body, the first and second discharge panels of the first panel are configured to be rotatable with respect to each other, the second panel is configured to be rotatable with respect to the body, and the first and second discharge panels of the second panel are configured to be rotatable with respect to each other, so that the first panel is configurable to be in a first position in which the first discharge panel of the first panel is aligned along a front face of the body and the second discharge panel of the first panel is inside the body, and a second position in which the first discharge panel of the first panel extends perpendicularly from the front face and the second discharge panel of the first panel extends at an acute angle from a distal end of the first discharge panel of the first panel to the body, and the second panel is configurable to be in a first position in which the first discharge panel of the second panel is aligned along the front face and the second discharge panel of the second panel is inside the body, and a second position in which the first discharge panel of the second panel extends perpendicularly from the front face and the second discharge panel of the second panel extends at an acute angle from a distal end of the first discharge panel of the second panel to the body.

2. The air conditioner of claim 1, further comprising:

rotation parts configured so that the first panel is rotatable with respect to the body, the first and second discharge panels of the first panel are configured to be rotatable with respect to each other, the second panel is configured to be rotatable with respect to the body, and the first and second discharge panels of the second panel are configured to be rotatable with respect to each other.

3. The air conditioner of claim 1, wherein the first discharge panel of the first panel includes at least one of a mesh and a porous material, and the first discharge panel of the second panel includes at least one of a mesh and a porous material.

4. The air conditioner of claim 2, further comprising:

at least one driving part configured to drive rotation of the first and second panels.

5. The air conditioner of claim 4, wherein the at least one driving part includes a first motor connected to the first panel and a second motor connected to the second panel.

6. The air conditioner of claim 4, wherein the at least one driving part is configured to control a rotation angle of each of the first panel and the second panel.

7. The air conditioner of claim 4, comprising a first guide configured to guide movement of the second discharge panel of the first panel from inside the body to outside the body, and a second guide configured to guide movement of the second discharge panel of the second panel from inside the body to outside the body.

8. The air conditioner of claim 7, further comprising a first stopper configured to restrict movement of the second discharge panel of the first panel, and a second stopper configured to restrict movement of the second discharge panel of the second panel.

9. The air conditioner of claim 7, further includes a first gear provided on the second discharge panel of the first panel and a first guide motor engaged with the first gear, and a second gear provided on the second discharge panel of the second panel and a second guide motor engaged with the second gear.

10. The air conditioner of claim 1, wherein when the first panel is in the first position, air inside the body is dischargeable through the plurality of holes of the first discharge panel of the first panel, and the opening of the second discharge panel of the first panel is covered by the body so that air inside the body is not dischargeable through the opening, and when the second panel is in the first position, air inside the body is dischargeable through the plurality of holes of the first discharge panel of the second panel, and the opening of the second discharge panel of the second panel is covered by the body so that air inside the body is not dischargeable through the opening.

11. The air conditioner of claim 1, wherein when the first panel is in the second position, the opening of the second discharge panel of the first panel is outside of the body so that air inside the body is dischargeable through the opening, and when the second panel is in the second position, the opening of the second discharge panel of the second panel is outside of the body so that air inside the body is dischargeable through the opening.

12. The air conditioner of claim 1, wherein when the first and second panels are both in the first positions, the first discharge panel of the first panel and the first discharge panel of the second panel are aligned with each other along the front face, and when the first and second panels are both in the second positions, the first discharge panel of the first panel and the first discharge panel of the second panel are adjacent to each other so that air inside the body is not dischargeable through the plurality of holes of the first discharge panel of the first panel or through the plurality of holes of the first discharge panel of the second panel.

13. The air conditioner of claim 1, wherein the first panel is configurable to be in at least one intermediate position between the first position and the second position, in which the first discharge panel of the first panel extends from the front face at an acute angle, and the second discharge panel of the first panel is at least partially outside of the body with at least a portion of the opening of the second discharge panel being outside the body, and the second panel is configurable to be in at least one intermediate position between the first position and the second position, in which the first discharge panel of the second panel extends from the front face at an acute angle, and the second discharge panel of the second panel is at least partially outside of the body with at least a portion of the opening of the second discharge panel being outside the body.

14. An air conditioner comprising:

a body; and a front panel including:

a first panel including a first discharge panel having a plurality of discharge holes formed therein to discharge air from inside the body, and a second discharge panel having an opening formed therein to discharge air from inside the body; and a second panel including a first discharge panel having a plurality of discharge holes formed therein to discharge air from inside the body, and a second discharge panel having an opening formed therein to discharge air from inside the body, wherein the first panel is configured to be rotatable with respect to the body, the first and second discharge panels of the first panel are configured to be rotatable with respect to each other, the second panel is configured to be rotatable with respect to the body, and the first and second discharge panels of the second panel are configured to be rotatable with respect to each other, so that the first panel is configurable to be in a first position in which the first discharge panel of the first panel is aligned along a front face of the body so that air inside the body is dischargeable through the plurality of holes in the first discharge panel of the first panel, and the second discharge panel of the first panel is inside the body so that the opening of the second discharge panel of the first panel is covered by the body, and a second position in which the first discharge panel of the first panel extends perpendicularly from the front face, and the second discharge panel of the first panel extends at an acute angle from a distal end of the first discharge panel of the first panel to the body so that at least a portion of the opening of the second discharge panel of the first panel is outside the body and air inside the body is dischargeable through the at least a portion of the opening, the second panel is configurable to be in a first position in which the first discharge panel of the second panel is aligned along the front face so that air inside the body is dischargeable through the plurality of holes in the first discharge panel of the second panel, and the second discharge panel of the second panel is inside the body so that the opening of the second discharge panel of the second panel is covered by the body, and a second position in which the first discharge panel of the second panel extends perpendicularly from the front face, and the second discharge panel of the second panel extends at an acute angle from a distal end of the first discharge panel of the second panel to the body so that at least a portion of the opening of the second discharge panel of the second panel is outside the body and air inside the body is dischargeable through the at least a portion of the opening, when the first and second panels are both in the first positions, the first discharge panel of the first panel and the first discharge panel of the second panel are aligned with each other along the front face, and when the first and second panels are both in the second positions, the first discharge panel of the first panel and the first discharge panel of the second panel are adjacent to each other so that air inside the body is not dischargeable through the plurality of holes of the first discharge panel of the first panel or through the plurality of holes of the first discharge panel of the second panel.

* * * * *